US010219595B2

(12) United States Patent
Tonelli

(10) Patent No.: US 10,219,595 B2
(45) Date of Patent: Mar. 5, 2019

(54) TRANSPORTABLE CONTAINER, AND RELATED METHOD OF PRODUCTION

(71) Applicant: G.T. LINE S.R.L., Frazione Crespellano (IT)

(72) Inventor: Massimo Tonelli, Casalecchio di Reno (IT)

(73) Assignee: G.T. LINE S.R.L., Frazione Crespellano (IT)

( * ) Notice: Subject to any disclaimer, the term of this patent is extended or adjusted under 35 U.S.C. 154(b) by 0 days.

(21) Appl. No.: 15/524,596

(22) PCT Filed: Nov. 5, 2014

(86) PCT No.: PCT/IT2014/000287
§ 371 (c)(1),
(2) Date: May 4, 2017

(87) PCT Pub. No.: WO2016/071929
PCT Pub. Date: May 12, 2016

(65) Prior Publication Data

US 2017/0318925 A1 Nov. 9, 2017

(51) Int. Cl.
*A45C 5/04* (2006.01)
*A45C 5/03* (2006.01)
(Continued)

(52) U.S. Cl.
CPC ..... *A45C 5/03* (2013.01); *A45C 5/02* (2013.01); *A45C 5/04* (2013.01); *A45C 13/04* (2013.01);
(Continued)

(58) Field of Classification Search
CPC ..... A45C 13/04; A45C 13/36; A45C 5/04
(Continued)

(56) References Cited

U.S. PATENT DOCUMENTS 4,770,312 A * 9/1988 O ..... A45C 5/02 190/107
5,000,301 A * 3/1991 Grenier ..... A45C 5/02 190/107
(Continued)

FOREIGN PATENT DOCUMENTS

EP 0359903 A2 3/1990

OTHER PUBLICATIONS

International Search Report dated Jul. 16, 2015 re: Application No. PCT/IT2014/000287; pp. 1-4; citing: EP 0 359 903 A2 and US 5 360 128 A.
(Continued)

*Primary Examiner* — Sue A Weaver
(74) *Attorney, Agent, or Firm* — Cantor Colburn LLP

(57) ABSTRACT

A transportable container includes at least one end plate and four side walls and which defines, in at least one configuration for use, at least one internal compartment for the placement of utensils, tools and objects in general. The container includes an interlocking coupling unit for the plate and at least one of the side walls; the unit includes at least one first profiled element, which is associated with one side of the plate and defines at least one first groove for guiding and partial accommodation of one of the side walls. The unit also includes at least one second profiled element, which is substantially perpendicular to the plate and defines at least one rail for guiding and partial coupling of the side wall.

16 Claims, 13 Drawing Sheets

(51) Int. Cl.
*A45C 5/02* (2006.01)
*A45C 13/04* (2006.01)
*A45C 13/36* (2006.01)

(52) U.S. Cl.
CPC ..... *A45C 13/36* (2013.01); *A45C 2005/037* (2013.01)

(58) Field of Classification Search
USPC ..... 190/24, 26, 37, 107; 220/4.26
See application file for complete search history.

(56) References Cited

U.S. PATENT DOCUMENTS

| | | | | |
|---|---|---|---|---|
| 5,360,128 | A | 11/1994 | Hessenthaler | |
| 5,634,539 | A * | 6/1997 | Gordon | A45C 5/02 190/24 |
| 2012/0012596 | A1* | 1/2012 | Hollebone | A45C 13/36 220/694 |

OTHER PUBLICATIONS

Written Opinion dated Jul. 16, 2015 re: Application No. PCT/IT2014/000287; pp. 1-6; citing: EP 0 359 903 A2.

* cited by examiner

TRANSPORTABLE CONTAINER, AND RELATED METHOD OF PRODUCTION

TECHNICAL FIELD

The present disclosure relates to a transportable container, and the related method of production.

BACKGROUND

In the vast sector of suitcases, trunks, and transportable containers in general, a particular type of suitcase is known which is usually referred to as a "flight case".

This term in fact is identified with a suitcase that is predominantly designed to transport utensils, instruments and items of equipment that are heavy and/or cumbersome, but which at the same time are delicate, such as for example musical instruments, loudspeakers and amplifiers, or equipment for photography or lighting, etc.

In order to thus ensure safe transport, without subjecting the contents to impacts, various stresses, and/or infiltrations of humidity, water, dust, etc., such suitcases usually have a structure that is capable of conferring a high level of strength and rigidity, as well as specific contrivances in order to ensure the seal at all points of discontinuity defined in areas where two or more components are joined.

In more detail, in order to ensure the capacity to resist impacts and the other stresses that containers of this type need to be capable of resisting, flight cases are substantially constituted by two box-like half-shells which are mutually articulated, and are constituted by walls of plywood (optionally lined internally with a fabric lining), which are mutually coupled by way of profiled elements in aluminum (arranged along the edges) and corner elements in steel (arranged at the corners).

Furthermore, as has been seen, adapted contrivances are adopted in order to ensure the necessary seal and prevent, as said, leaks of water, dust, etc., which are potentially capable of damaging the instruments and tools accommodated inside.

Such implementation solutions are not devoid of drawbacks, however.

The necessity of assembling suitcases with components made of different materials requires substantially artisan and/or manual procedures, which require the intervention of an operator, who takes care of associating the various components with each other.

Such activity is greatly slowed and complicated by the plurality of screws, rivets, and other, similar fixing elements, which the operator must progressively make use of, in order to obtain the desired final assembly.

In addition to lengthening the overall time necessary for assembly, the insertion of screws and rivets imposes continual interruptions of the steps of mutual assembly of the main components (walls, profiled elements and corner elements), since only by quickly fixing together (with screws and rivets, and occasionally also with adhesive bonding) the components that are progressively being assembled, will the structure of the suitcase being formed be stable, without the risk of its deforming or collapsing during the assembly.

In addition it should be noted that during assembly, and often before obtaining the finished suitcase, the operator is called on to arrange, along the walls, various inserts, blocks, locators etc., which are necessary in order to equip the suitcase with inner panels, pockets or other accessories.

It seems evident that such requirements result in a further increase of the overall time required for assembly, with an unwanted increase of the manufacturing costs.

SUMMARY

The aim of the present disclosure is to solve the above mentioned problems, by providing a transportable container that can be assembled in a practical and easy manner.

Within this aim, the disclosure provides a method that makes it possible to provide a transportable container in a practical and easy manner.

The disclosure also provides a method that offers the possibility of providing a transportable container with various customizations, without complicating or slowing the activities of assembly thereof.

The disclosure further provides a transportable container that can be easily assembled and which at the same time ensures high reliability in operation, high resistance to impacts and a hermetic seal.

The disclosure also provides a method that makes it possible to obtain a transportable container in a practical and fast manner, without resorting to adhesive bonding.

The disclosure further provides a transportable container that can be easily implemented using elements and materials that are readily available on the market.

The disclosure provides a method that is simple to implement and at low cost.

These advantages which will become better apparent hereinafter are achieved by providing a transportable container, comprising at least one end plate and four side walls and which defines, in at least one configuration for use, at least one internal compartment for the placement of utensils, tools and objects in general, wherein it comprises an interlocking coupling unit for said plate and at least one of said side walls, said unit comprising at least one first profiled element, which is associated with one side of said plate and defines at least one first groove for guiding and partial accommodation of one of said side walls, and at least one second profiled element, which is substantially perpendicular to said plate and defines at least one rail for guiding and partial coupling of said side wall, said unit comprising at least one barb, which protrudes stably from said plate and faces toward said second profiled element, said at least one barb being engaged in an interlocking fashion with a respective contoured portion of said side wall, for stable coupling between said plate and said at least one wall.

These advantages are also achieved by providing a method for providing a transportable container, which comprises at least one end plate and four side walls and defines, in at least one configuration for use, at least one internal compartment for the placement of utensils, tools and objects in general, wherein it includes arranging said end plate, which is provided with at least one first profiled element, which is comprised in an interlocking coupling unit for said plate, and said at least one wall, said first profiled element being associated with one side of said plate and defining at least one first groove for guiding and partial accommodation of one of said side walls; in arranging at least one second profiled element, which is comprised in said unit and defines at least one rail for guiding and partial coupling of said at least one side wall, perpendicularly to said plate and facing toward a barb, which is comprised in said unit and stably protrudes from said plate; and in guiding said at least one side wall along said rail up until its partial accommodation in said first groove of said first profiled element and up until the simultaneous interlocking engagement of a respective contoured portion thereof with said barb, for stable coupling between said plate and said at least one wall.

BRIEF DESCRIPTION OF THE DRAWINGS

Further characteristics and advantages of the disclosure will become better apparent from the description of a preferred, but not exclusive, embodiment of the container according to the disclosure, which is illustrated by way of non-limiting example in the accompanying drawings wherein.

DETAILED DESCRIPTION OF THE DRAWINGS

Figure 1:
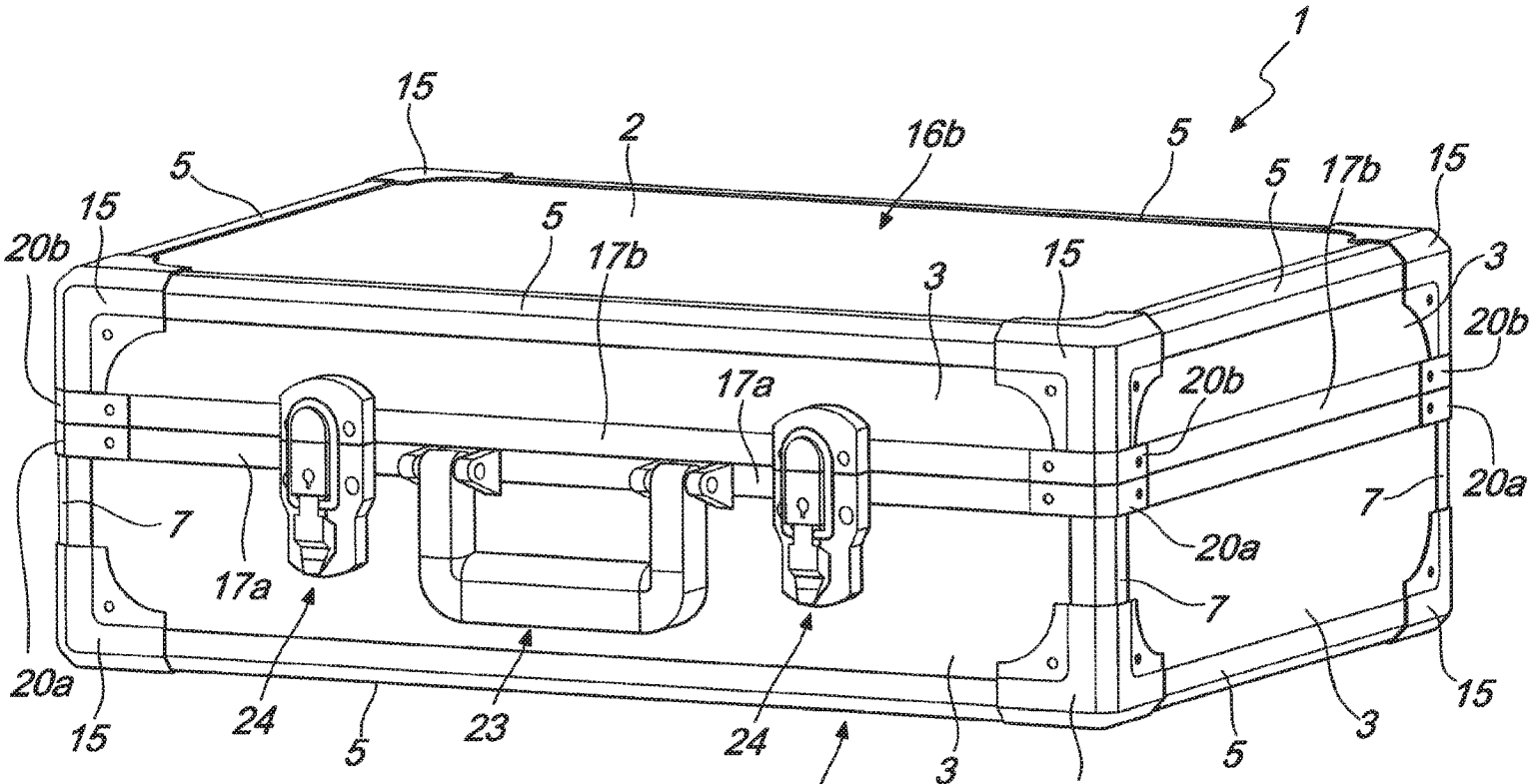
FIG. 1 is a perspective view of the container according to the disclosure.

With particular reference to the figures, the reference numeral 1 generally designates a transportable container, which comprises at least one end plate 2 (substantially rectangular) and four side walls 3 (also substantially rectangular), and which defines, in at least one configuration for use (in which the container 1 is shown in FIG. 1), at least one internal compartment 4 in which utensils, tools and objects in general can be placed.

It should be noted from this point onward that the transportable container 1 according to the disclosure can be of any type (a suitcase, a trunk, a trolley case, etc.) and be intended for professional users (in any area of industry) or for private use, while remaining within the scope of protection claimed herein.

Moreover, in the preferred application of the disclosure, to which reference will be made in the present discussion by way of non-limiting example, the container 1 is a suitcase of the "flight case" type. Such expression identifies a suitcase with high performance levels in terms of seal, rigidity, resistance to impacts and stresses, in that it is predominantly used to transport utensils, instruments and items of equipment that are heavy and/or cumbersome, but which at the same time are delicate.

Figures 14, 15, 15A:
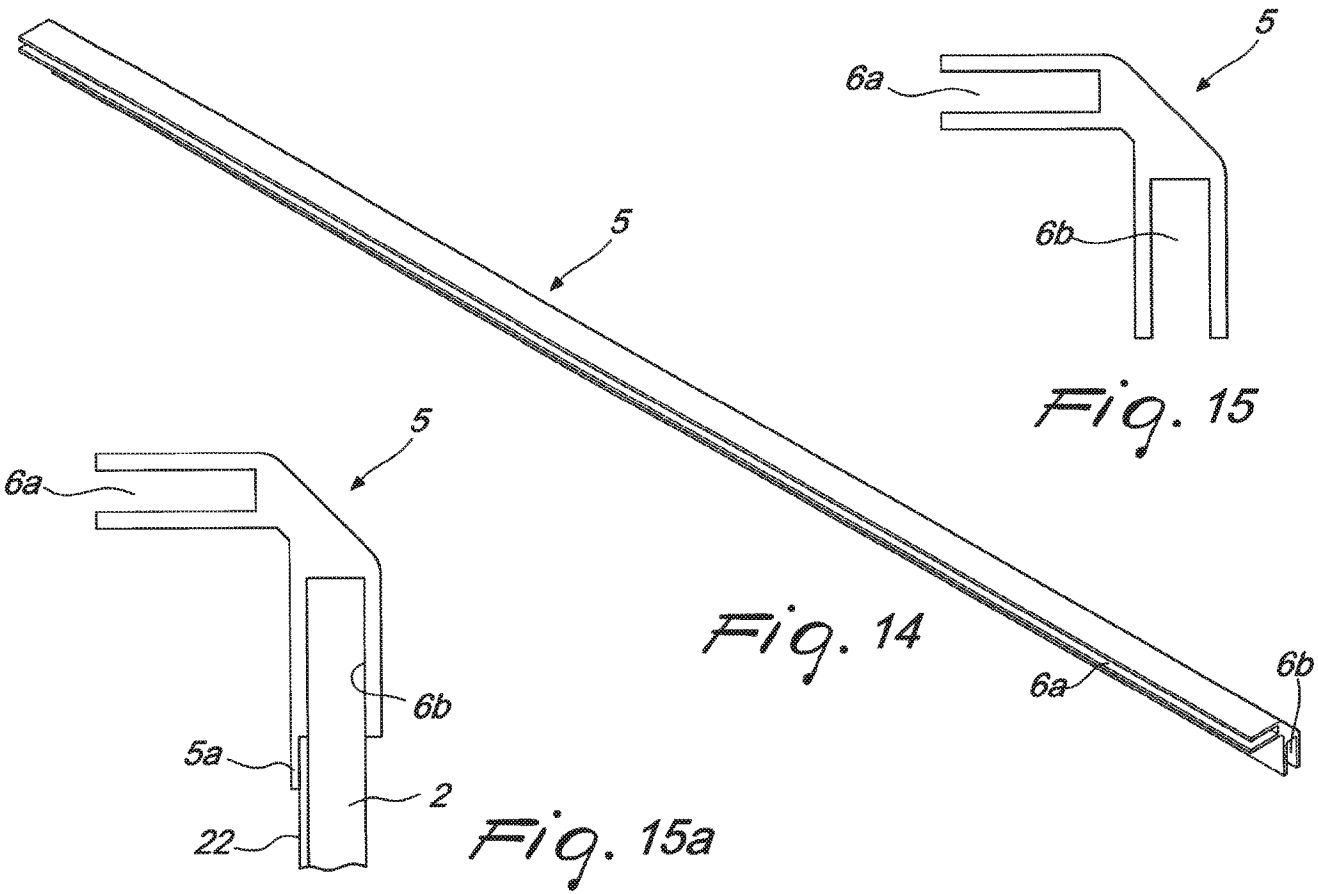
FIG. 14 is a perspective view of the first profiled element.
FIG. 15 is a side elevation view of the first profiled element.
FIG. 15*a* is a side elevation view of a variation of embodiment of the first profiled element.

According to the disclosure, the container 1 comprises an interlocking coupling unit for the plate 2 and at least one side wall 3, which comprises first of all at least one first profiled element 5 (shown in detail for example in FIGS. 14 and 15 and preferably made of aluminum), which is substantially associated with one side 2*a* of the plate 2 (according to various methods, some of which will be explained hereinafter). The first profiled element 5 defines at least one first groove 6*a* for guiding and partial accommodation of one of the side walls 3.

Figure 17:
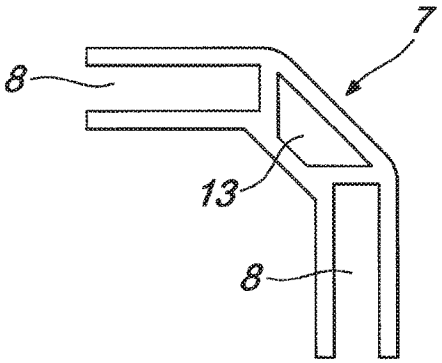
FIG. 17 is a side elevation view of the second profiled element.
Figure 16:
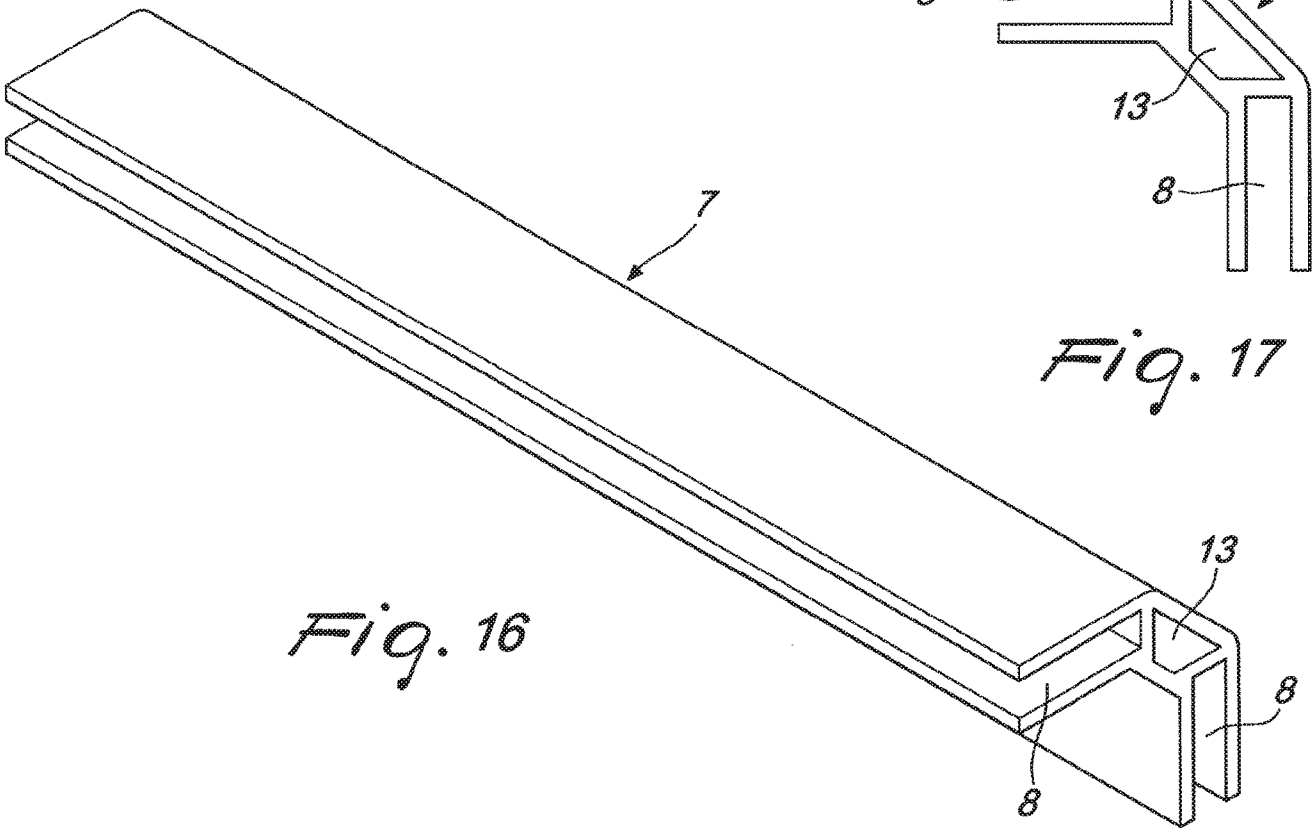
FIG. 16 is a perspective view of the second profiled element.
Figure 18:
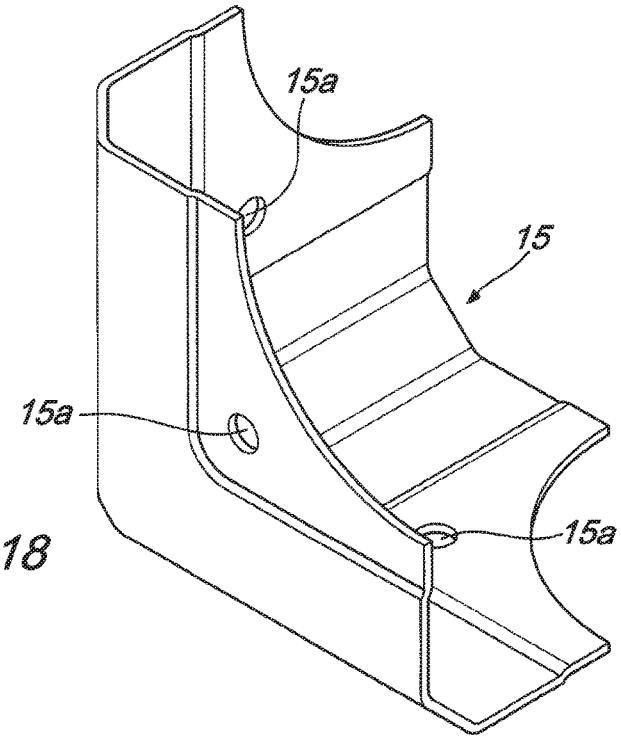
FIG. 18 is a perspective view of a first additional component of the container according to the disclosure.
Figure 19:
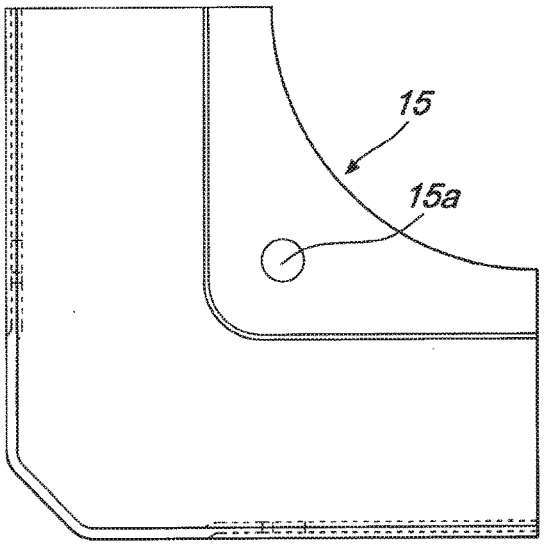
FIG. 19 is a side elevation view of the first additional component in FIG. 18.

Furthermore, the interlocking coupling unit comprises at least one second profiled element 7 (illustrated in detail for example in FIGS. 16 and 17 and preferably made of aluminum) which is arranged substantially perpendicular to the plate 2 (at a corner thereof adjacent to the side 2*a* facing and proximate to the first profiled element 5). Such second profiled element 7 defines at least one rail 8 for guiding and partial coupling of the side wall 3, which is already affected by the first profiled element 5.

In addition the unit comprises at least one barb 9, which protrudes stably from the plate 2, and more precisely from the above mentioned corner, and is thus facing toward the second profiled element 7.

The barb 9 engages by interlocking with a respective contoured portion 10 of the side wall 3, so as to ensure stable coupling between the plate 2 and the wall 3 (and without thus resorting to screws, rivets, nails and other, similar fixing elements).

Figure 2:
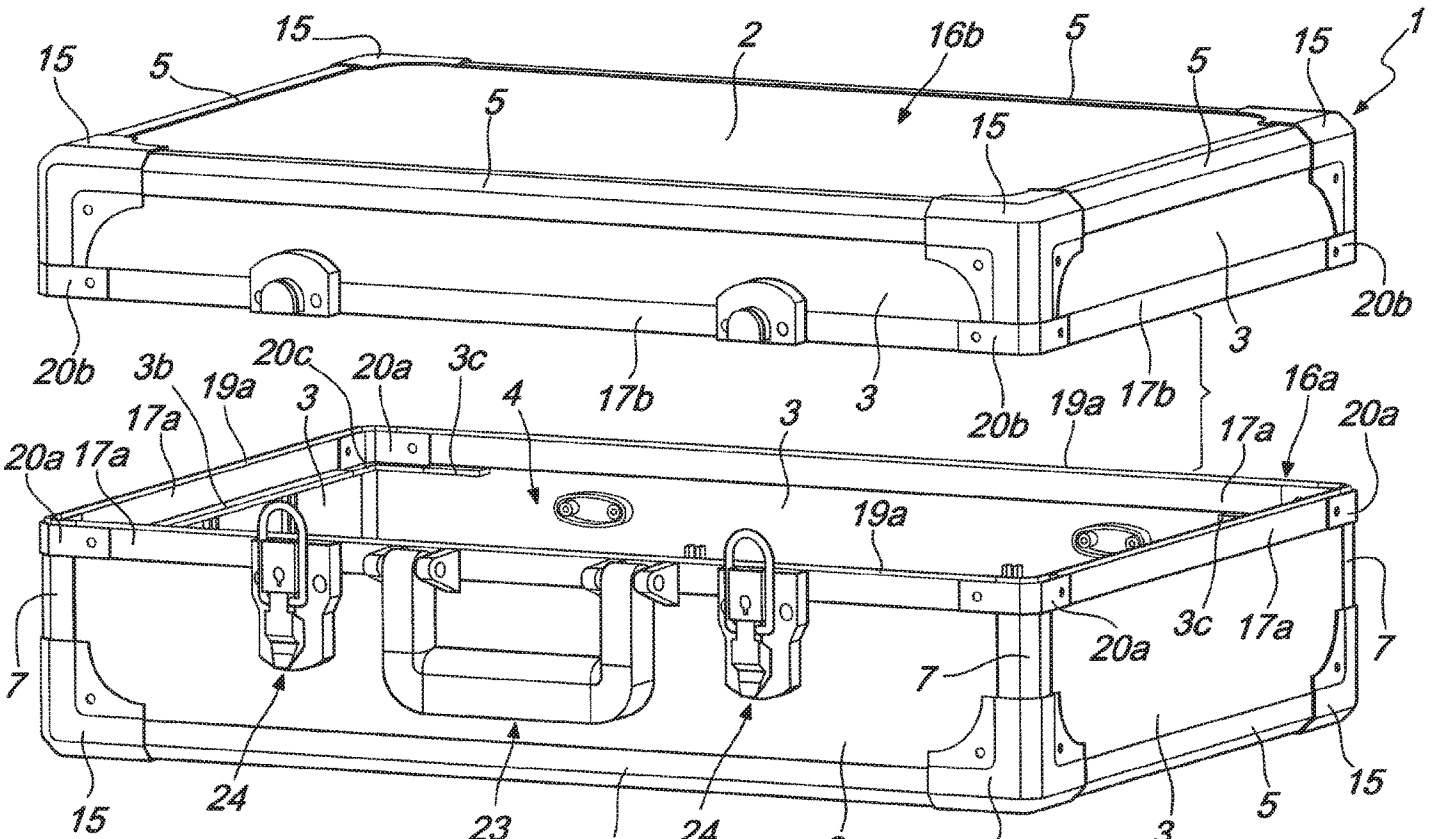
FIG. 2 is a partially exploded perspective view of the container in FIG. 1.
Figure 3:
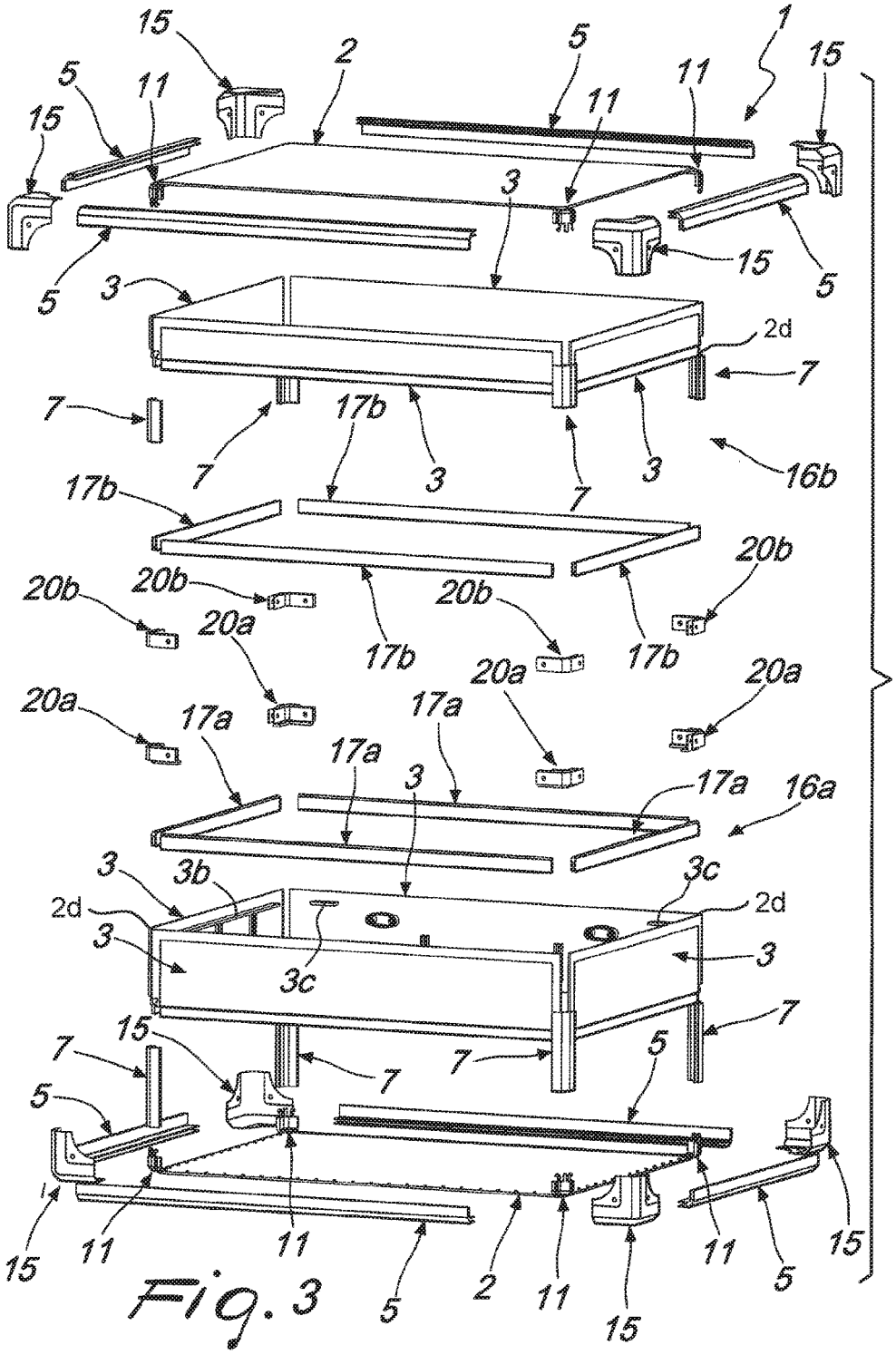
FIG. 3 is a completely exploded perspective view of the container in FIG. 1.
Figure 4:
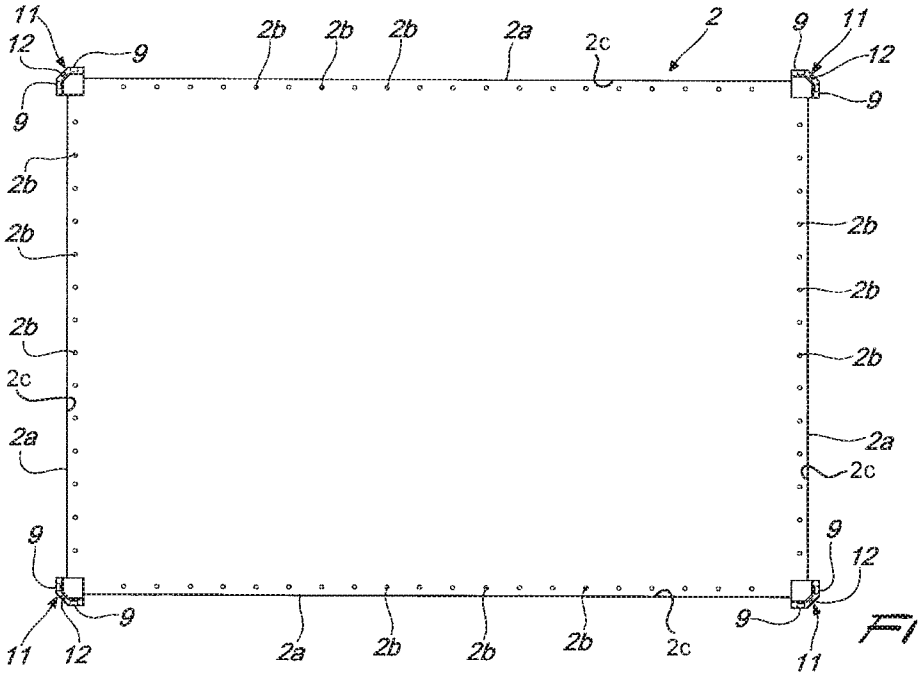
FIG. 4 is a view from above of the end plate.
Figure 5:
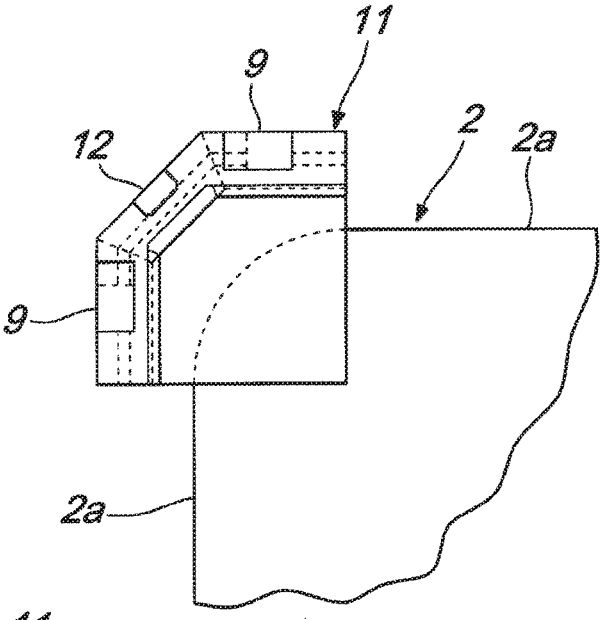
FIG. 5 is a greatly enlarged detail of FIG. 4.
Figure 6:
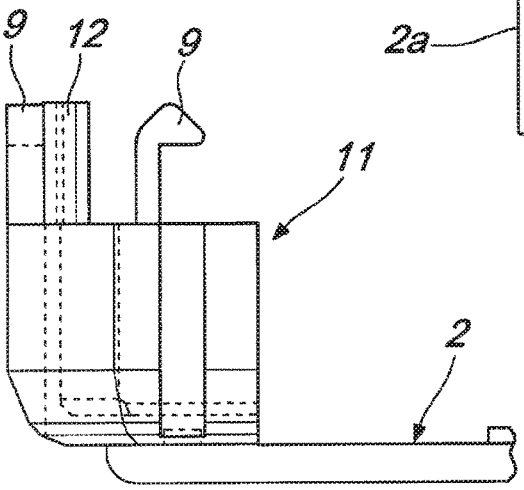
FIG. 6 is a side elevation view of the detail shown in FIG. 5.
Figure 7:
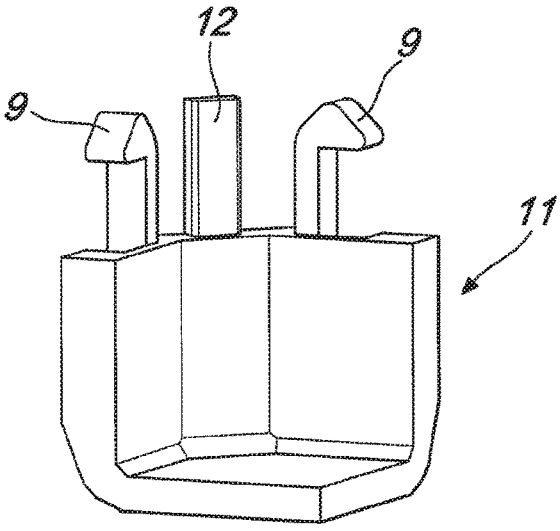
FIG. 7 is a perspective view of the detail shown in FIG. 5, without the end plate.
Figure 8:
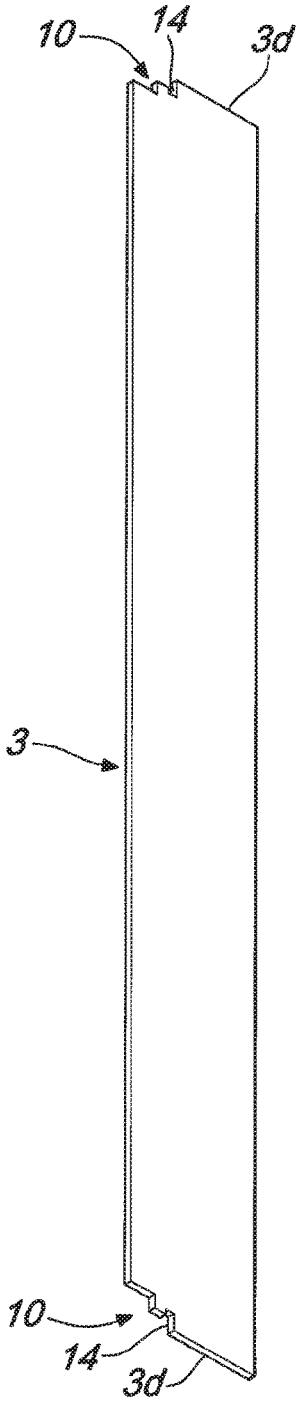
FIG. 8 is a perspective view of the exterior of a first side wall.
Figure 9:
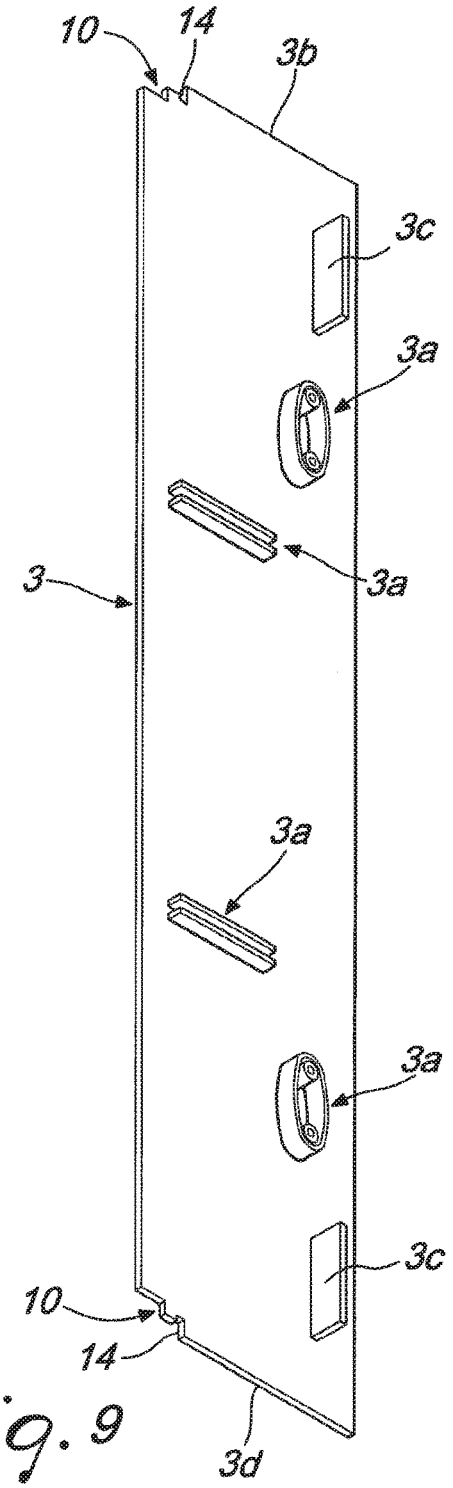
FIG. 9 is a perspective view of the interior of the first side wall in FIG. 8.

In particular, in a first embodiment, which is illustrated for the purposes of non-limiting example in the accompanying drawings, as can be seen from FIGS. 1 to 3 the unit comprises at least four first profiled elements 5: each first profiled element 5 defines a first groove 6*a* and a second groove 6*b* (parallel to the first).

The first groove 6*a* and the second groove 6*b* are thus respectively adapted to guide and partially accommodate a corresponding side wall 3 and a corresponding side 2*a* of the plate 2.

Furthermore, the unit comprises at least four second profiled elements 7, which are substantially perpendicular to the plate 2 (at its four corners) and are such as to define respective pairs of rails 8 for guiding and partial coupling, for corresponding contiguous pairs of side walls 3, which thus are mutually coupled thanks to the respective second profiled element 7 interposed between them.

It should be noted that (in this and/or in other embodiments) the first profiled elements 5 can be perforated by longitudinal through holes (or dead holes), which are arranged between the grooves 6*a*, 6*b*, in order to lighten the structure and reduce the quantity of raw material used.

In a different embodiment (which does not exhaust the possible methods of manufacturing and marketing the container 1 according to the disclosure), it is the plate 2 that defines, at its four sides 2*a*, four respective first profiled elements 5.

For example, the plate 2 and the four first profiled elements 5 can constitute a single piece that is obtained by molding, thus further reducing the costs and the time to assemble the container 1 according to the disclosure.

In such embodiment, each first profiled element 5 defines a respective first groove 6*a* for guiding and partial accommodation of a corresponding side wall 3.

Furthermore (as with the preceding embodiment), the unit comprises at least four second profiled elements 7, which are substantially perpendicular to the plate 2 and which define respective pairs of rails 8 for guiding and partial coupling, for corresponding contiguous pairs of side walls 3.

Whichever embodiment is chosen, thanks to the peculiar methods for coupling adopted, which as has been seen do not require screws, nails, rivets or the like, conveniently both the end plate 2 and the side walls 3 can be made of a polymeric material, and obtained by molding (as briefly mentioned for the second embodiment).

Such choice makes it possible to easily obtain by molding, on the inside of the walls 3, optional impressions 3*a* or inserts, of various shapes and types, which are intended to constitute a locator and a fixing element for brackets, pockets, panels, laces, retention means, etc, to be inserted in the container 1 in the final steps of its assembly.

Obviously, the implementation choice described above makes it possible to obtain receptacles, orifices, or the like, in an equally simple manner (and without requiring subsequent work).

Figure 10:
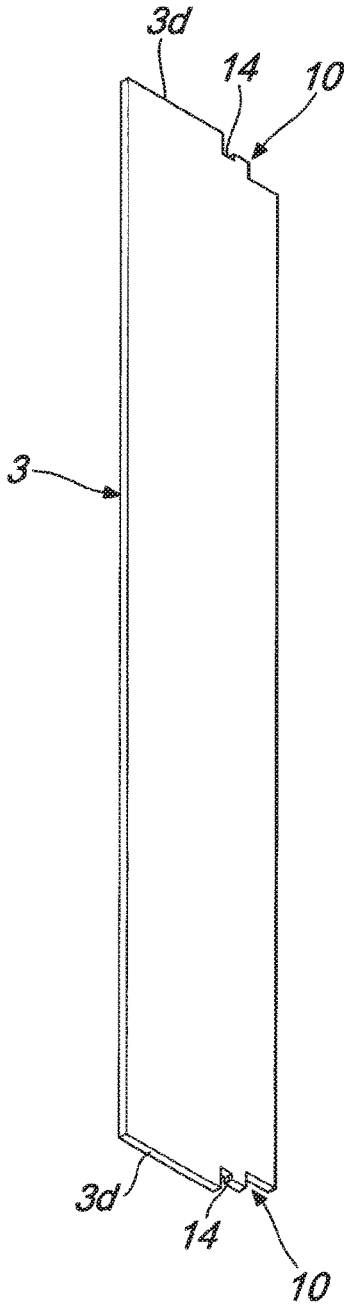
FIG. 10 is a perspective view of the exterior of a second side wall.
Figure 11:
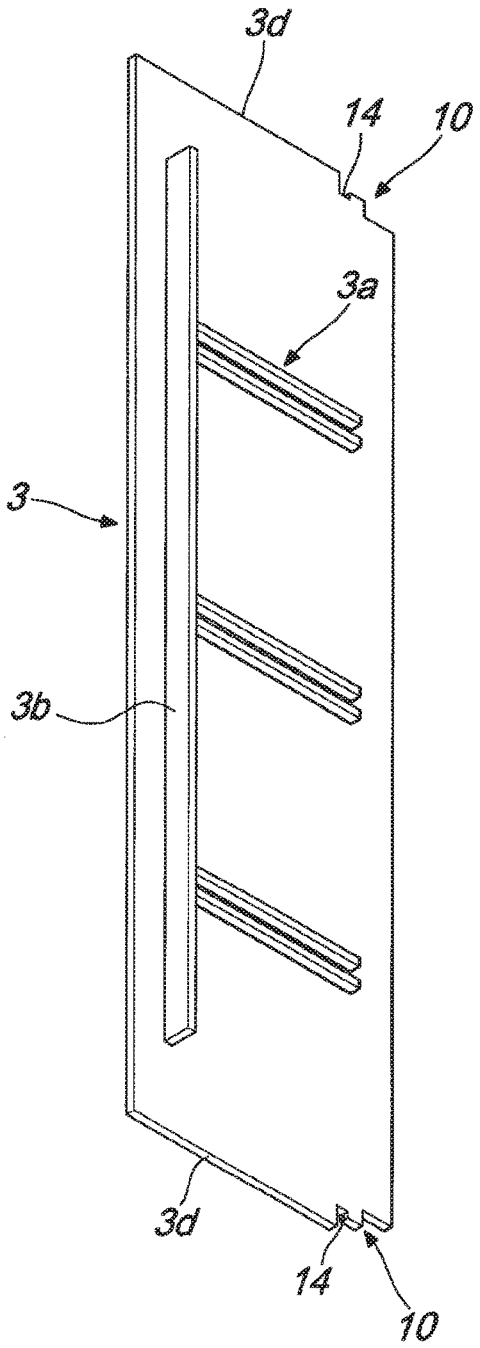
FIG. 11 is a perspective view of the interior of the second side wall in FIG. 10.
Figure 12:
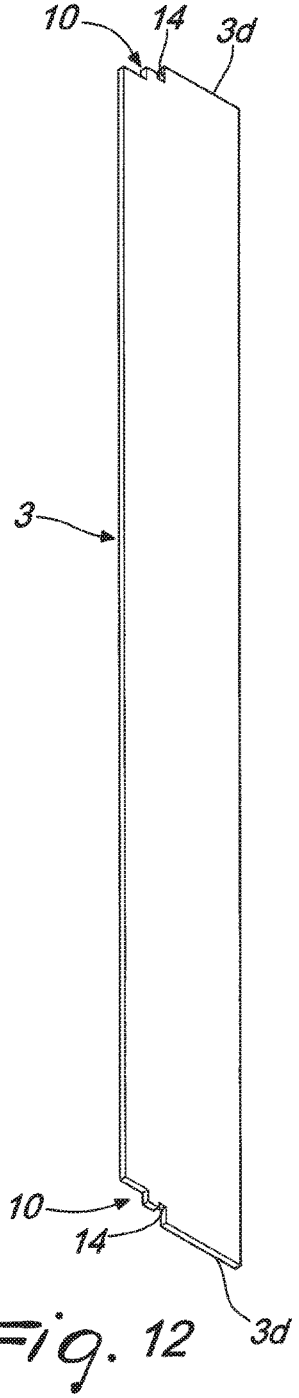
FIG. 12 is a perspective view of the exterior of a third side wall.
Figure 13:
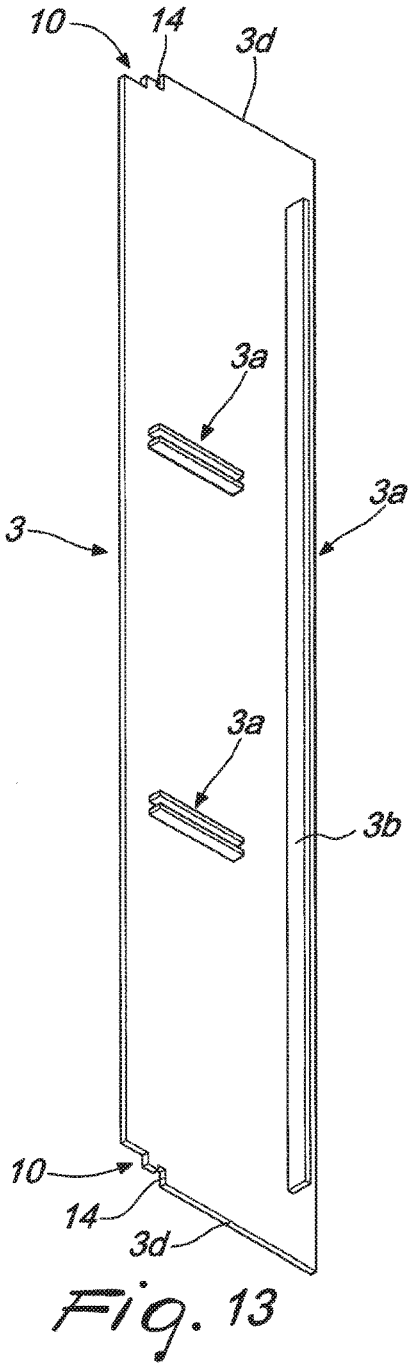
FIG. 13 is a perspective view of the interior of the third side wall in FIG. 12.

For example at least on the wall 3 that is intended to constitute the front wall 3 (illustrated in FIGS. 12 and 13) and on the walls 3 contiguous thereto (FIGS. 10 and 11), there can be respective ledges 3*b*, arranged at the same vertical height. On the ledges 3*b* an additional panel can thus be rested in a simple and practical manner, configurable at will, for the purpose of best dividing the compartment 4 and/or for retaining various tools and utensils.

Furthermore, stulls 3*c* can protrude in a cantilever fashion from the rear wall 3, and be arranged at the same vertical height as the ledges 3*b* and be designed to cooperate with them to support the additional panel (and also be obtained by molding in a similar manner to the ledges 3*b*).

Positively (and as can be seen for example from FIGS. 3 to 7), the unit comprises at least one corner body 11, which is arranged stably at a corner of the plate 2.

The corner body 11 has a pair of barbs 9, mutually side by side and engaged by interlocking with respective contoured portions 10 of corresponding contiguous pairs of side walls 3.

Conveniently, the corner body 11 also comprises a central shank 12, interposed in parallel between the above mentioned pair of barbs 9 and inserted at least partially into an axial duct 13, which is defined internally with respect to the respective second profiled element 7.

In this manner, during assembly of the container 1 according to the disclosure, the shank 12 offers a guide and a locator for the second profiled element 7, with respect to the plate 2, as will become better apparent hereinafter.

With further reference to the solution illustrated in the accompanying figures, the unit comprises at least four corner bodies 11, which are stably arranged at the four corners of the plate 2.

Each corner body 11 thus has respective pairs of barbs 9, mutually side by side and engaged by interlocking with corresponding contoured portions 10 of corresponding contiguous pairs of side walls 3.

Even more specifically, each side wall 3 comprises two contoured portions 10, which are substantially constituted by respective cuts 14 made along corresponding mutually opposite edges 3*d* of the wall 3, such edges 3*d* being accommodated in the corresponding guide rails 8 of the second profiled elements 7.

Conveniently, the container 1 comprises at least one corner housing 15 for covering and structural reinforcement, which is applied externally to the container 1 at at least of one of the previously mentioned corners of the plate 2. The housing 15, which preferably is made of steel (in order to give the necessary rigidity to the entire structure of the container 1) and which can be fixed by way of nails or screws inserted in respective openings 15*a* that are defined along its surface, is thus arranged to cover a respective corner body 11 and, partially, to cover the plate 2 and the corresponding adjacent side walls 3.

As can be seen from the accompanying figures, preferably each corner body 11 is covered by a respective housing 15, thus ensuring the maximum rigidity of the structure of the container 1.

It should be made clear that, in a first possible embodiment, the container 1 according to the disclosure can comprise the plate 2, the four side walls 3 (and the respective interlocking coupling unit) and an upper lid, which is arranged to close the compartment 4 in the configuration for use and is articulated to a wall 3, in order to allow the opening of the container 1 and access to the compartment 4.

In the embodiment proposed in the accompanying figures, which does not exhaust the possible methods of implementation of the disclosure, the container 1 comprises a first half-shell 16*a* and a second half-shell 16*b*, which is arranged to close the first half-shell 16*a* in the configuration for use (so as to jointly delimit the compartment 4) and is movable from the configuration for use to a configuration for free access to the compartment 4, and vice versa.

Each half-shell 16*a*, 16*b* (as is clear from the accompanying FIGS. 1, 2 and 3) thus has an end plate 2, four side walls 3 and an interlocking coupling unit, in order to ensure stable coupling between each plate 2 and the four respective side walls 3.

Obviously, in order to provide the desired coupling between the two half-shells 16*a*, 16*b*, the container 1 can be provided with hinges or similar articulation elements (or more besides, according to specific requirements), which are conveniently associated with two mutually opposite side walls 3 of each half-shell 16*a*, 16*b*.

More generally, with regard to the impressions 3*a*, the inserts, the ledges 3*b*, etc., the walls 3 of one of the half-shells 16*a*, 16*b* can be configured identically or differently with respect to those of the other half-shell 16*a*, 16*b* (as moreover is the case in the example in the accompanying figures), while remaining within the scope of protection claimed herein.

It must be noted that the pins and/or the respective seats, which are necessary in order to provide the hinge (or in any case the rotary mating between the two half-shells 16*a*, 16*b*) can be provided on respective side walls 3 and be obtained by molding together with the side walls 3.

Advantageously, the transportable container 1 comprises at least one first batten 17*a* (shown for example in FIG. 20), that defines a first longitudinal slotway 18*a* which partially accommodates a respective side wall 3 of the first half-shell 16*a*, on the opposite side with respect to the corresponding plate 2.

Furthermore, the transportable container 1 comprises at least one second batten 17*b* (shown for example in FIG. 20), that defines a second longitudinal slotway 18*b* (of identical shape and dimensions to those of the first longitudinal slotway 18*a*) which partially accommodates a respective side wall 3 of the second half-shell 16*b*, on the opposite side with respect to the corresponding plate 2.

In the preferred embodiment, as can also be seen from the accompanying figures, the container 1 is provided with four first battens 17*a* (each one coupled to a respective wall 3 of the first half-shell 16*a* at its first slotway 18*a*) and four second battens 17*b* (each one coupled to a respective wall 3 of the second half-shell 16*b* at its second slotway 18*b*).

In the configuration for use, the respective battens 17*a*, 17*b* of the two half-shells 16*a*, 16*b* are thus brought into contact (as can be clearly seen in FIG. 1).

Figures 20, 21:
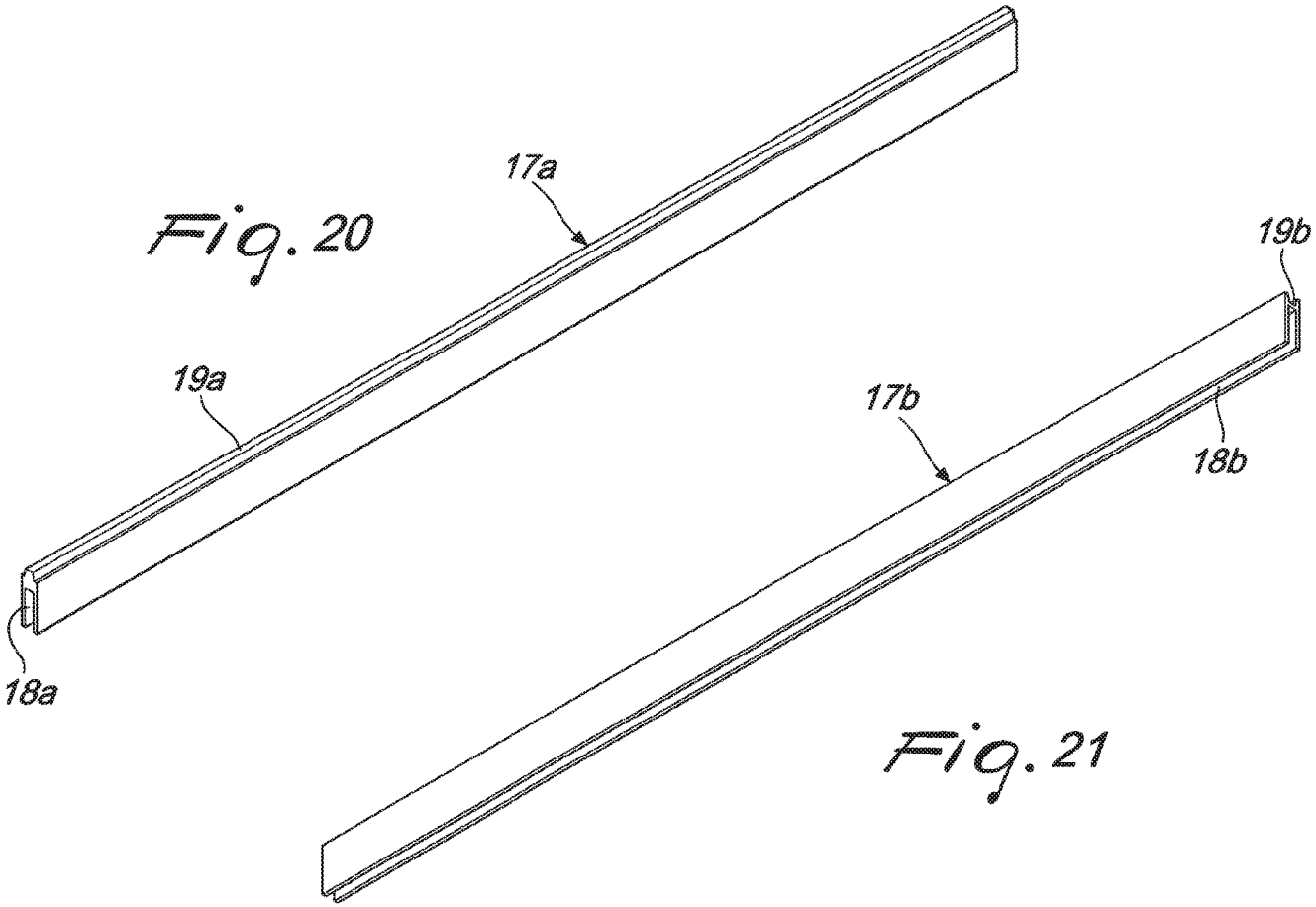
FIG. 20 is a perspective view of a second additional component of the container according to the disclosure.
FIG. 21 is a perspective view of a third additional component of the container according to the disclosure.

As can be seen in FIGS. 20 and 21, the first batten 17*a* has, on the opposite side with respect to the first slotway 18*a*, a longitudinal crest 19*a* of matching shape to a longitudinal notch 19*b* provided along the second batten 17*b*, on the opposite side with respect to the second slotway 18*b*.

In this manner, in the configuration for use, when the second half-shell 16*b* is arranged so as to close the first half-shell 16*a*, and the compartment 4, each crest 19*a* is inserted in the respective notch 19*b*, thus ensuring optimal coupling and ensuring a perfect seal against the infiltration of water, air, dust, etc., right at a critical region of discontinuity, in which, in conventional "flight case" containers, fissures are often formed and lead to leaks and/or the introduction of dust or air.

Figure 22:
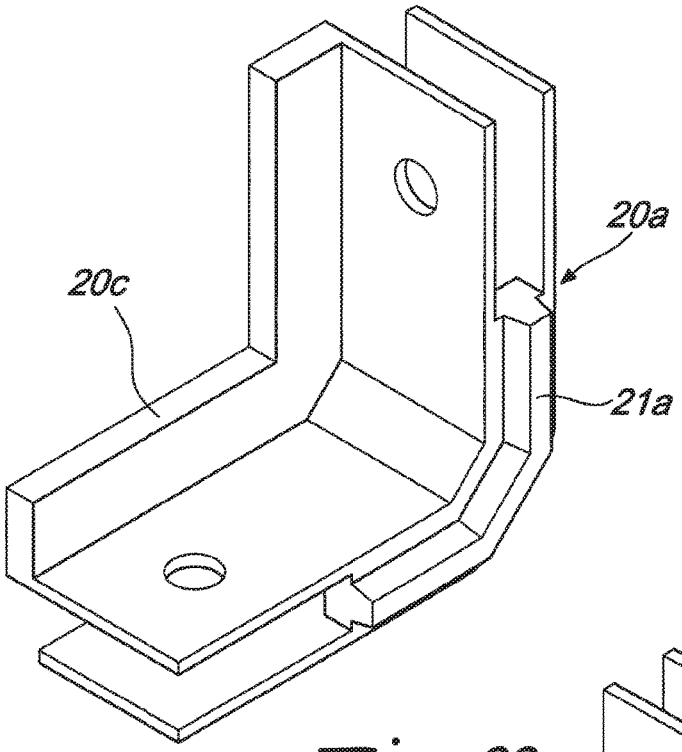
FIG. 22 is a perspective view of a fourth additional component of the container according to the disclosure.

Advantageously, the container 1 comprises at least one first corner rib 20*a*, which is shown in detail in FIG. 22, is L-shaped and is provided with a substantially U-shaped transverse cross-section. Thanks to a such specific shape structure, a first rib 20*a* can be interposed between two first battens 17*a* and partially accommodate respective corner flaps 2*d* of a respective contiguous pair of side walls 3 of the first half-shell 16*a*, on the opposite side with respect to the corresponding end plate 2.

Figure 23:
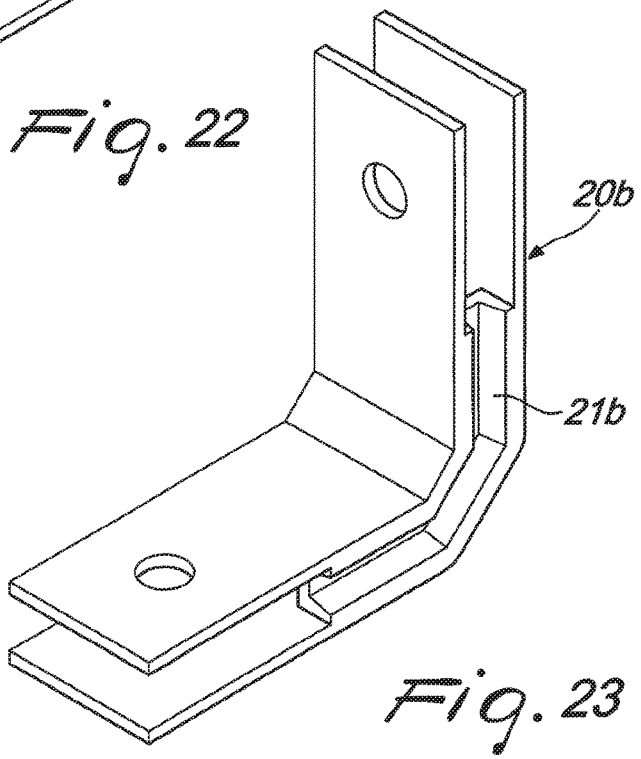
FIG. 23 is a perspective view of a fifth additional component of the container according to the disclosure.

Similarly, the container 1 also comprises at least one second corner rib 20*b*, which is also L-shaped and is substantially U-shaped in transverse cross-section and is shown in detail in FIG. 23; according to the method explained above for the first rib 20*a*, the second rib 20*b* partially accommodates respective corner flaps 2*d* of a respective contiguous pair of side walls 3 of the second half-shell 16*b*, on the opposite side with respect to the corresponding end plate 2.

Furthermore, the first rib 20*a* has, on the opposite side with respect to the plate 2 of the first half-shell 16*a*, a protruding longitudinal tongue 21*a*, which can perform a shape mating with a complementarily-shaped recess 21*b*, which is defined by the second rib 20*b*, on the opposite side with respect to the corresponding plate 2 of the second half-shell 16*b*.

In the preferred embodiment the container 1 is provided with four first ribs 20*a* (each one of which is interposed between two first battens 17*a* and associated with a corresponding contiguous pair of walls 3 of the first half-shell 16*a*) and four second ribs 20*b* (each one of which is interposed between two second battens 17*b* and associated with a corresponding contiguous pair of walls 3 of the second half-shell 16*b*).

Thus, when the second half-shell 16*b* is arranged so as to close the first half-shell 16*a*, and the compartment 4, the accommodation of each tongue 21*a* in the respective recess 21*b* completes the coupling, described previously, between the crests 19*a* and the notches 19*b* of the battens 17*a*, 17*b*, thus ensuring an optimal seal in the region of discontinuity interposed between the two half-shells 16*a*, 16*b*.

It should be noted that the first ribs 20*a* and/or the second ribs 20*b* can be provided in a polymeric material (and possibly be obtained by molding) or in a metallic material (aluminum for example, obtaining the ribs 20*a*, 20*b* by die casting), if it is wished to give greater rigidity to the whole.

It should be noted that the first corner rib 20*a* preferably has, at the opposite end with respect to the tongue 21*a*, a flat lip 20*c*, which is facing inwardly. The lip 20*c* is conveniently arranged at a height that is such as to be in perfect alignment with a ledge 3*b* and the contiguous stull 3*c* and has a length equal to the lack of continuity between these latter two items (as can be seen in FIG. 2), in order to cooperate with them so as to define a support for an optional additional panel.

It should be noted that, in an alternative embodiment of the container 1 according to the disclosure, the latter comprises a first rectangular bezel composed of four slats which are substantially similar to the four first battens 17*a* and are mutually and rigidly associated, so as to form a single element (which is even more practical and even easier to manage and assemble). Likewise, in such alternative embodiment the container 1 also comprises a second rectangular bezel (of matching shape to the first), which in turn is composed of four slats that are similar to the four second battens 17*b*.

Along the slats, respective grooves can be obtained directly by molding or milling (or by way of other forms of machining), which simulate the longitudinal slotways 18*a*, 18*b* or the notches 19*b*, and/or the profile of the slats can be shaped so as to replicate the crests 19*a*.

Conveniently, the container 1 can comprise at least one lining for the inner covering of the end plate 2, which is provided with a plurality of perimetric holes. Thus, respective protrusions 2*b* can be inserted into the perimetric holes, and directed toward the compartment 4 and distributed along respective perimetric flaps 2*c* of the end plate 2 (as can be seen from FIG. 4), which are accommodated in respective second grooves 6*b* of the first profiled elements 5.

The choice to provide the protrusions 2*b* (which by being inserted into the perimetric holes of the lining ensure the coupling thereof with the plate 2) along perimetric flaps 2*c* of the plate 2, which are kept accommodated in the second grooves 6*b*, and thus in fact covered and lined by the first profiled elements 5, makes it possible to protect and hide from view such region of mutual coupling, thus obtaining internally a more attractive appearance and more generally a coupling that is more stable and long-lasting.

In an alternative embodiment, the container 1 comprises an inner covering lamina 22 (made of a rigid material of the type of aluminum, of another metallic material or, preferably, of a polymeric material). Further impressions 3*a*, inserts, and other devices for fastening or locating can be arranged on the lamina 22 in advance, and thus be immediately and easily available for installing drawers, internal dividers and other accessories in the container 1, in a practical and easy manner.

In order to facilitate the mounting of the lamina 22, a variation of the first profiled element 5 (shown in FIG. 15*a*) is provided, in which, proximate to the second groove 6*b*, a tooth 5*a* extends from the first profiled element 5 and thus defines a shoulder against which the lamina 22 can abut, when it is rested on the plate 2. The tooth 5*a* keeps the lamina 22 in position and, with the shoulder, offers a practical reference locator in the assembly step, moreover with no need to modify the first groove 6*b* (thus rendering such variation of embodiment adapted both for containers 1 equipped with the lamina 22 and without it).

The stable anchoring of the lamina 22 to the end plate 2, and more generally to the other components of the container 1 according to the disclosure, is ensured in a practical and easy manner by the nails or by the screws (referred to in the foregoing pages) that are inserted into the openings 15*a* of the housing 15 which face toward the end plate 2, and are responsible for fixing the housing 15 (without therefore having to provide further specific fixing elements).

It should be noted finally that the transportable container 1 according to the disclosure can be completed with further adapted accessories, such as for example a handle 23 and/or one or more locks 24.

The method according to the disclosure is thus aimed at the provision (assembly) of a transportable container (be it a suitcase of the "flight case" type, or otherwise) that comprises at least one end plate 2 and four side walls 3 and which defines, in at least one configuration for use, at least one internal compartment 4 in which utensils, tools and objects in general can be placed.

According to the disclosure, the method includes in a first step a., of arranging the end plate 2, which is provided with at least one first profiled element 5, which is comprised in an interlocking coupling unit for the plate 2, and at least one wall 3. Such first profiled element 5 is associated with one side 2*a* of the plate 2 and defines at least one first groove 6*a* for guiding and partial accommodation of a side wall 3.

Subsequently, in a step b., the method according to the disclosure includes arranging at least one second profiled element 7, which is comprised in the unit and is such as to define at least one rail 8 for guiding and partial coupling of the side wall 3, perpendicularly to the plate 2 and facing toward a barb 9, which is comprised in the unit and stably protrudes from the plate 2.

Subsequently, the method according to the disclosure includes a step c., of guiding at least one side wall 3 along the rail 8 up until its partial accommodation in the first groove 6*a* of the first profiled element 5 and, simultaneously, up until a respective contoured portion 10 thereof engages, by interlocking, with the barb 9, thus resulting in stable coupling between the plate 2 and the wall 3.

More specifically, with reference to the first embodiment described in detail in the foregoing pages (and illustrated in the accompanying figures), the step a. of arrangement involves partially accommodating the end plate 2 (with its end flaps and its sides 2*a*) in four second grooves 6*b* which are defined by four corresponding first profiled elements 5 (which are parallel to the four sides 2*a* of the plate 2).

In turn, the step b. includes arranging four second profiled elements 7, which define four corresponding pairs of rails 8, perpendicularly to the plate 2 and facing toward four relative pairs of barbs 9. Finally, the step c. involves guiding each side wall 3 along respective mutually opposite rails 8, up until the partial accommodation of each one of them in four first grooves 6*a* of four respective first profiled elements 5, and, simultaneously, up until the interlocking engagement of corresponding contoured portions 10 of the side walls 3 with the four barbs 9.

As an alternative, and with reference to the second embodiment proposed in the foregoing pages, while the steps b. and c. are substantially similar to those described in the previous paragraph, the step a. involves arranging a plate that defines, at its four sides 2*a*, four respective first profiled elements 5. Each first profiled element 5 (which is obtained for example by molding, together with the plate 2), defines thus a respective first groove 6*a* in which to accommodate partially a corresponding side wall 3.

It must be noted that obviously the steps a., b. and c. can in any case be repeated for each half-shell 16*a*, 16*b*, if the method is implemented for the provision (the assembly) of a container 1 that has both.

Conveniently, the method involves, at the end of the step c. of guiding, applying externally to the container 1, in a step d., at least one corner housing 15 for covering and structural reinforcement, at a corner of the plate 2.

Thus, the housing 15 is capable of covering a respective corner body 11, which is stably arranged at such corner that is provided with the barbs 9.

Obviously, in the preferred implementation each corner of the plate 2 is provided with a respective corner body 11, and is covered and strengthened by a corresponding housing 15.

If the container 1 is constituted by two half-shells 16*a*, 16*b*, in the last part of the production (assembly) method according to the disclosure, it will obviously be possible to provide the mutual articulation between the half-shells 16*a*, 16*b*, for example by way of hinges or the like, which can be obtained by molding, together with respective mutually opposite side walls 3 of the two half-shells 16*a*, 16*b*, or subsequently mounted on the latter.

In any case, it should be noted that in fact, after completing the step c., the four side walls 3 are partially accommodated in the first grooves 6*a* of the first profiled elements 5, which are associated with the four sides 2*a* of the plate 2 and in fact constitute four edges of the container 1 (or of each half-shell 16*a*, 16*b*).

Furthermore, the four side walls 3, with their edges 3*d*, are accommodated in the guide rails 8 defined by the second profiled elements 7, which in fact constitute another four edges of the container 1 (or of each half-shell 16*a*, 16*b*).

At such mutual arrangement, which an operator can assemble in an evidently practical and easy manner, without having to resort to any utensil, fixing element or adhesive bonding, the contoured portions 10 of the side walls 3 are stably engaged with the barbs 9 that protrude from the plate 2.

The cooperation of the couplings ensured by the profiled elements 5, 7 and by the barbs 9, thus result in stable coupling between the plate 2 and the four walls 3, and such result is obtained only by interlocking (and again, without adhesives, screws, nails, and the like), thus offering the possibility of assembling a suitcase or other container 1 with a method that is absolutely practical and easy.

At the end of the step c. therefore, the container 1 (each half-shell 16*a*, 16*b*) is by now completely assembled, at least in its main structure, which is already absolutely stable, although without screws, rivets or the like (which may be used at another time, in order to increase the rigidity), and thus with an overall assembly time that is undoubtedly contained, and far lower than that required for similar conventional containers.

It should be noted likewise that such result (the complete assembly of the container 1, or at least of its main structure) is also obtained without having to resort to adhesive bonding, further confirmation of the simplicity and practicality of the method according to the disclosure.

Such stable structure moreover makes it possible to perform the final steps of assembly (and optionally the assembly of handles 23, locks 24 and other accessories) in total simplicity, in that the operator can already handle the container 1 (or each half-shell 16*a*, 16*b*) completely safely and without risk of deformations, collapses or failures of the mutual couplings.

Furthermore, the use of housings 15 in steel, and the choice to provide the container 1 with profiled elements 5, 7 in aluminum, increases the rigidity and the resistance to impacts, thus ensuring high reliability in operation.

As has been seen in the foregoing pages, in order to facilitate the correct placement of the second profiled element 7, in step b. described above, each corner body 11 has a shank 12 that is inserted at least partially into an axial duct 13, which is defined internally by each second profiled element 7, thus offering for the latter a useful locator during assembly.

It should likewise be noted that the simple mutual coupling methods described for the plate 2 and the side walls 3 make it possible to provide such components in polymeric material. This makes it possible to provide the plate 2 and the side walls 3 by molding, and thus makes it possible to provide optional impressions 3*a* or inserts (on the walls 3, but optionally also on the inner face of the plate 2). Thus, it is possible to equip the container 1 (in the final steps of assembly, and without complicating the rest of the method), with dividers, pockets, elements for retaining utensils, etc., thus obtaining various customizations, without complicating or slowing the activities of assembly thereof.

Finally, it should be noted again that the battens 17*a*, 17*b*, and the ribs 20*a*, 20*b* (which can also be easily assembled by interlocking), ensure the necessary seal without requiring special contrivances or machining, but simply by taking advantage of the peculiar geometries given to them.

In practice it has been found that the transportable container and the method according to the disclosure fully achieve the set advantages, in that the use of an interlocking coupling unit for the plate and at least one side wall, which comprises at least one first profiled element, at least one second profiled element, and at least one barb, makes it possible to provide a transportable container that can be assembled in a practical and easy manner.

The disclosure, thus conceived, is susceptible of numerous modifications and variations, all of which are within the scope of the appended claims. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

The invention claimed is:

1. A transportable container, comprising at least one substantially rectangular end plate and four substantially rectangular side walls and which defines, in at least one configuration for use, at least one internal compartment for the placement of utensils, tools and objects in general, and further comprising an interlocking coupling unit for receiving said plate and at least one of said side walls, said interlocking coupling unit comprises:

at least one first profiled element associated with one side of said plate and defines at least one first groove configured for guiding and partial accommodation of one of said side walls, at least one second profiled element disposed substantially perpendicular to said plate and defines at least one rail configured for guiding and partial coupling of one of said side walls, and at least one barb, which protrudes stably from said plate and faces toward said second profiled element, said at least one barb being engaged with a contoured portion of said side wall configured for coupling between said plate and at least one of said side walls.

2. The transportable container according to claim 1, wherein said unit comprises at least four said first profiled elements, each one of said first profiled elements defining a said first groove and a second groove, respectively for guiding and partial accommodation of a corresponding said side wall and a corresponding said side of said plate, said unit comprising at least four said second profiled elements, which are substantially perpendicular to said plate and define respective pairs of said rails for guiding and partial coupling, for corresponding contiguous pairs of said side walls.

3. The transportable container according to claim 2, comprising at least one lining of inner covering of said end plate, which is provided with a plurality of perimetric holes, for the insertion of respective protrusions, which are directed toward said compartment and are distributed along perimetric flaps of said end plate, which are accommodated in respective said second grooves of said first profiled elements.

4. The transportable container according to claim 1, wherein said container includes four of said first profiled elements disposed at each of said sides, each one of said first profiled elements defining a first groove configured for guiding and partial accommodation of a corresponding said side wall, and said container further includes at least four of said second profiled elements disposed substantially perpendicular to said plate and define respective pairs of said rails configured for guiding and partial coupling, for corresponding contiguous pairs of said side walls.

5. The transportable container according to claim 4, wherein each one of said side walls comprises two of said contoured portions, which are substantially constituted by respective cuts made along corresponding mutually opposite edges, which are accommodated in corresponding said rails of said second profiled elements.

6. The transportable container according to claim 1, wherein said end plate and said side walls are provided in a polymeric material and are obtained by molding.

7. The transportable container according to claim 1, wherein said unit comprises at least one corner body stably arranged at a corner of said plate and has a pair of said barbs disposed side by side and are engaged by interlocking with respective contoured portions of corresponding contiguous pairs of said side walls.

8. The transportable container according to claim 7, wherein said corner body comprises a central shank, which is interposed parallel between said pair of said barbs and is inserted at least partially into an axial duct, which is defined internally by said at least one second profiled element, for guiding and reference of said second profiled element, with respect to said plate, during assembly.

9. The transportable container according to claim 7, comprising at least one corner housing applied externally to at least one corner of said plate, said at least one corner housing configured for covering and structurally reinforcing, at least one corner and, partially, to cover said plate and said corresponding adjacent side walls.

10. The transportable container according to claim 1, comprising a first half-shell and a second half-shell, which is arranged to close said first half-shell in said configuration for use and is moveable from said configuration for use to a configuration for free access to said compartment, and vice versa, each one of said half-shells having a said end plate, four said side walls and a said interlocking coupling unit, for the stable coupling between each one of said plates and the respective said four side walls.

11. The transportable container according to claim 10, comprising at least one first batten, which defines a first longitudinal slotway for partial accommodation of a respective said side wall of said first half-shell, on the opposite side with respect to the corresponding said plate, and at least one second batten, which defines a second longitudinal slotway for partial accommodation of a respective said side wall of said second half-shell, on the opposite side with respect to the corresponding said plate, said first batten having, on the opposite side with respect to said first slotway, a longitudinal crest, the shape of which is complementary to a longitudinal notch defined along said second batten, on the opposite side with respect to said second slotway.

12. The transportable container according to claim 11, comprising at least one first corner rib, which is L-shaped and is substantially U-shaped in transverse cross-section, for partial accommodation of respective corner flaps of a respective contiguous pair of said side walls of said first half-shell, on the opposite side with respect to the corresponding said end plate, and at least one second corner rib, which is L-shaped and is substantially U-shaped in transverse cross-section, for partial accommodation of respective corner flaps of a respective contiguous pair of said side walls of said second half-shell, on the opposite side with respect to the corresponding said end plate, said first rib having, on the opposite side with respect to said plate of said first half-shell, a protruding longitudinal tongue, for shape mating with a complementarily-shaped recess, which is defined by said second rib, on the opposite side with respect to said plate of said second half-shell.

13. A method for providing a transportable container, which comprises at least one substantially rectangular end plate and four substantially rectangular side walls and defines, in at least one configuration for use, at least one internal compartment for the placement of utensils, tools and objects in general, the method including the following steps:

a. arranging said end plate, which is provided with at least one first profiled element, which is comprised in an interlocking coupling unit for receiving said plate and at least one of said side walls, said first profiled element being associated with one side of said plate and defining at least one first groove configured for guiding and partial accommodation of one of said side walls;

b. arranging at least one second profiled element, which is comprised in said unit and defines at least one rail configured for guiding and partial coupling of said at least one of said side walls, perpendicularly to said plate and facing toward at least one barb, which is comprised in said unit and stably protrudes from said plate;

c. guiding said at least one side wall along said rail until said side wall is partially accommodated in said first groove of said first profiled element and until the simultaneous interlocking engagement of a respective contoured portion with said barb configured for stable coupling between said plate and said at least one wall.

14. The method according to claim 13, wherein said step a. involves partial accommodation of said end plate in four second grooves for guiding and partial accommodation, which are defined by four corresponding said first profiled elements, said step b. providing for arranging four said second profiled elements, which define four corresponding pairs of said rails, perpendicularly to said plate and facing toward four corresponding pairs of said barbs, said step c. providing for guiding each one of said side walls along respective mutually opposite rails until the partial accommodation of said side walls in four corresponding said first grooves of said four first profiled elements and until the simultaneous interlocking engagement of corresponding said contoured portions of said side walls with said barbs.

15. The method according to claim 13, wherein said step a. involves arranging said plate that defines, at the four sides, four respective said first profiled elements, each one of said first profiled elements defining a respective said first groove, said step b. providing for arranging four said second profiled elements, which define four corresponding pairs of said rails, perpendicularly to said plate and facing toward four corresponding pairs of said barbs, said step c. providing for guiding each one of said side walls along respective mutually opposite rails until the partial accommodation of said side walls in four corresponding said first grooves of said four first profiled elements and until the simultaneous interlocking engagement of corresponding said contoured portions of said side walls with said barbs.

16. The method according to claim 13, wherein it involves, at the end of said guiding step c., applying, externally to the container, in a step d., at least one corner housing for covering and structural reinforcement, to at least one corner of said plate, to cover a corner body, which is stably arranged at said corner and has said pair of said barbs.

* * * * *